United States Patent [19]

Long, Jr.

[11] Patent Number: 4,520,524

[45] Date of Patent: Jun. 4, 1985

[54] REMOTELY CONTROLLED HYDRAULIC CLEANER APPARATUS

[76] Inventor: Charles A. Long, Jr., 4144 Sharpsburg Dr., Birmingham, Ala. 35213

[21] Appl. No.: 593,453

[22] Filed: Mar. 26, 1984

[51] Int. Cl.[3] ..... B08B 9/02

[52] U.S. Cl. ..... 15/104.3 R; 15/104.09; 15/104.12; 15/104.13

[58] Field of Search ..... 15/104.05, 104.12, 104.13, 15/104.14, 104.3 R, 104.09; 118/72, DIG. 10

[56] References Cited

U.S. PATENT DOCUMENTS

| | | | |
|---|---|---|---|
| 3,267,504 | 8/1966 | Cook et al. | 15/104.14 |
| 4,418,437 | 12/1983 | French | 15/104.09 |
| 4,434,815 | 3/1984 | Flaherty | 15/104.09 X |

*Primary Examiner*—Edward L. Roberts

*Attorney, Agent, or Firm*—Panitch Schwarze Jacobs & Nadel

[57] ABSTRACT

A remotely controlled hydraulically operated cleaner apparatus for use in cleaning the interior of a conduit or pipe comprises a control means located outside of the conduit for generating control signals for controlling the operation of the cleaner apparatus. A source of pressurized hydraulic fluid is connected to valve means for receiving and distributing hydraulic fluid in accordance with control signals received from the control means. The apparatus further includes a housing containing a hydraulically powered motor adapted to receive hydraulic fluid from the valve means. An adjustable cleaner tool means is provided for cooperating with the motor for rotation relative to the conduit, the cleaner tool means being adjustable in order to maintain engagement with the interior walls of the conduit. The housing is supported within the conduit by an adjustable support means and a hydraulically actuated means is provided for receiving hydraulic fluid from the valve means for adjusting the adjustable support means to maintain the housing generally radially centered within the conduit. In the presently preferred embodiment, the cleaner tool means and the support means are concurrently adjustable and cooperate to have the same relative outer boundary to engage the conduit.

18 Claims, 19 Drawing Figures

REMOTELY CONTROLLED HYDRAULIC CLEANER APPARATUS

BACKGROUND OF THE INVENTION

The present invention relates generally to a remotely controlled, hydraulically operated cleaner apparatus and, more particularly, to such an apparatus which is adapted for use in the cleaning of elongated conduits or pipes of differing sizes.

It is generally well known that conduits or pipes which are employed for conducting fluids, for example, sanitary sewer pipes, storm sewer pipes, water lines and gas lines, frequently require cleaning to remove residue, debris or other such materials which through use and over time are deposited on and build up upon the interior surfaces or walls of such pipes. If such encrusted materials are permitted to continually build up upon the interior walls of such pipes, the overall internal diameter of the fluid conducting opening decreases, thereby decreasing fluid flow capacity through the pipe. It therefore is desirable to periodically loosen and remove the built-up material from such pipes in order to maintain desired flow rates.

In addition, such underground conduits or pipes frequently develop leaks which may be due to improper initial installation of the pipe, deterioration of the pipe itself due to aging or the effects of corrosive materials, cracking of the pipe or pipe joints due to environmental conditions such as earthquakes or similar natural or man made vibrations, or any other such causes. Because of ever increasing labor and machinery costs, it is becoming increasingly more difficult, at least economically, to dig up and replace those pipes or portions of pipes which may be leaking. As a result, a method called the Insituform process has been devised for the in situ repair or rehabilitation of the existing pipes. In the Insituform process, which is described in U.S. Pat. Nos. 4,009,063; 4,064,221; and 4,135,953, an elongated flexible tubular liner comprised of a felt or form material which is impregnated with a thermal setting synthetic resin is installed within the existing pipe utilizing an inverting process as described in the aforesaid patents. Once the liner is in place within the pipe, the liner is pressurized from within, preferably utilizing a high temperature fluid, to force the liner radially outwardly to engage and conform to the interior surface of the pipe. The resin is then cured to form a relatively hard, tight fitting, rigid pipe lining which effectively seals any cracks and repairs any pipe or joint deterioration to prevent further leakage either into or out of the pipe.

Although the Insituform process has been shown to be effective in the repair and rehabilitation of leaking pipes, the process is most effective when the liner is installed within a pipe which is relatively free of built-up material. Not only will the tubular liner adhere better to the pipe wall than to the deposited material, but if the liner is installed over the built-up material, the flow capacity of the pipe may be further diminished. It is therefore desirable to provide an apparatus for cleaning such pipes prior to the installation of an Insituform or similar type of pipe liner.

Although there are many pipe cleaning devices which are presently available, they are generally of a type which, once installed and operating within a pipe, are not readily adjustable to compensate for variations in the diameter of the pipe. While such prior art devices are relatively effective in cleaning pipes having a constant interior diameter or an interior diameter which only varies slightly, they are ineffective in cleaning pipes having varying interior diameters. Unfortunately, many existing sewer pipes have varying diameters and, therefore the prior art pipe cleaning devices cannot be efficiently utilized to clean such pipes.

The present invention provides a remotely controlled cleaner apparatus which is remotely adjustable during use within a pipe or conduit to permit the cleaning of pipes or conduits having varying interior diameters.

SUMMARY OF THE INVENTION

Briefly stated, the present invention comprises a remotely controlled, hydraulically operated cleaner apparatus for use in cleaning the interior of a conduit comprising: control means located outside of the conduit for generating control signals for controlling the operation of the cleaner apparatus; a source of pressurized hydraulic fluid; valve means for receiving both pressurized hydraulic fluid from the fluid source and control signals from the control means and for distributing the received hydraulic fluid in accordance with the received control signals; a housing; a hydraulically powered motor within the housing, said motor receiving hydraulic fluid from the valve means for operation thereof; adjustable cleaner tool means cooperating with the motor for rotation relative to the conduit upon operation of the motor, said cleaner tool means being adjustable to maintain engagement with the interior walls of the conduit; adjustable support means for supporting the housing within the conduit; hydraulically actuated means for receiving hydraulic fluid from the valve means and for adjusting the adjustable support means to maintain the housing generally radially centered within the conduit whereby the housing is moved along the conduit with the motor in operation so that the cleaner tool means rotate while engaging in the interior conduit walls for cleaning the interior of the conduit.

BRIEF DESCRIPTION OF THE DRAWINGS

The foregoing summary, as well as the following detailed description, will be better understood when read in conjunction with the appended drawings. For the purpose of illustrating the invention, there is shown in the drawings an embodiment which is presently preferred, it being understood, however, that this invention is not limited to the precise arrangement and instrumentalities shown. In the drawing.

DESCRIPTION OF A PREFERRED EMBODIMENT

Figure 1:
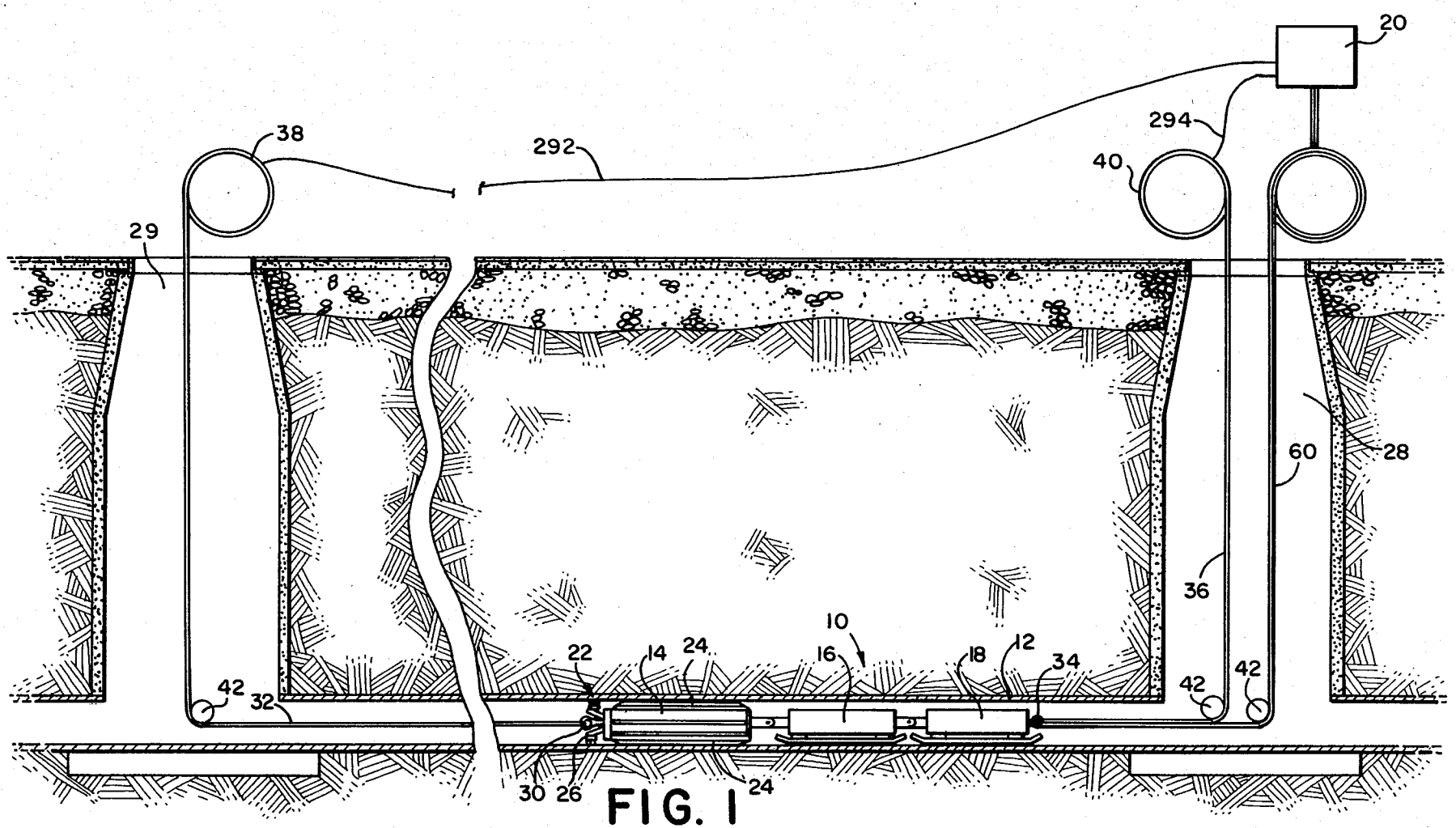
FIG. 1 is an elevation view of a preferred embodiment of the hydraulic cleaner apparatus of the present invention installed with a broken away subterranean sewer pipe.

Referring to the drawings, wherein like numerals are employed for the indication of like elements throughout, there is shown in FIG. 1 a front elevation view (partially schematic) of a remotely controlled hydraulically operated cleaner apparatus indicated generally as 10, in operation within a subterranean conduit or pipe, such as sewer pipe 12, which is shown as being partially broken away. In the presently preferred embodiment, the cleaner apparatus 10 is shown and described as being employed for the purpose of cleaning the interior of a subterranean sewer pipe 12 for the loosening and removal of built-up material (not shown) from the sewer pipe walls to prepare the sewer pipe for the installation of a pipe liner, such as a thermosetting plastic liner (not shown). It should be understood and appreciated, however, that the cleaner apparatus 10 may also be employed for other related purposes, such as the routine cleaning of sewer pipes or other conduits with or without such liners.

In the presently preferred embodiment, the cleaner apparatus 10 is comprised of a plurality of operational assemblies contained within three separate elongated housings 14, 16 and 18 which are sequentially or serially coupled or attached together, in a manner which will hereinafter be described, for concurrent movement in a single line along the sewer pipe 12 as shown. In the present embodiment, each such housing 14, 16 and 18 is generally cylindrical and is comprised of a section of steel pipe having an outer diameter of approximately six and one-eighth inches and two appropriately sized disc-like steel end plates for enclosing the ends of the steel pipe section. Each housing supports one or more operational assemblies as will hereinafter be described in detail.

In addition to the operational assemblies contained within housings 14, 16 and 18, which are installed within the sewer pipe 12, there is provided a control means or control assembly 20 which, for purposes which will hereinafter become apparent, is located on the surface as shown. A suitable control cable such as a multiple conductor electrical control cable 60 interconnects the control assembly 20 and the operational assemblies located with housings 14, 16 and 18. The control assembly 20 generates control signals to provide a means for an operator to remotely control the operation of the operational assemblies of the cleaner apparatus 10. A more detailed description of the structure and operation of the control assembly 20 will be hereinafter set forth.

As shown in FIG. 1, the forward most, or left most housing 14 contains a rotatable cleaner tool means or cleaner head (shown generally as 22) and adjustable support means in the present embodiment four supporting skids, only two of which are shown in FIG. 1 as 24. Hydraulically actuated means (not shown in FIG. 1) within the forward housing 14 are provided for moving or adjusting the supporting skids 24 radially inwardly or outwardly as shown to engage the interior surface of the sewer pipe 12 for centering and supporting the housing 14 within the sewer pipe. Similarly, means (not shown in FIG. 1) are provided for moving the cleaner tool means 22 radially inwardly or outwardly to engage the interior of the sewer pipe. The forward housing 14 also includes means (not shown in FIG. 1) for rotating the cleaner tool means 22 relative to the housing 14 for the rotation of the cleaner tools, in the present embodiment cleaner brushes 26 against the sewer pipe interior surface for the removal of built up material as previously discussed. The hydraulically actuated means for adjusting the radial position of the supporting skids 24 and the cleaner tools or brushes 26 as well as the means for the rotation of the cleaner tool means or cleaner head 22 are hydraulically powered and will hereinafter be described in detail.

The second or intermediate housing 16 includes a hydraulic fluid reservoir (not shown in FIG. 1) to provide a source of hydraulic fluid and hydraulic valve means (not shown in FIG. 1) for directing or distributing pressurized hydraulic fluid in accordance with received control signals. The pressurized hydraulic fluid is transmitted to the forward housing 14 for effecting the radial adjustment of the supporting skids 24 and the cleaner brushes 26 and for the rotational movement of the cleaner head 22.

The rear (rightmost) housing 18 contains a hydraulic pump (not shown in FIG. 1) and means for driving the hydraulic pump (also not shown in FIG. 1) to pressurize hydraulic fluid received from the hydraulic fluid reservoir.

In operation, the three housings 14, 16 and 18 are initially installed within a subterranean sewer pipe 12 by way of an existing manhole 28. The three housings 14, 16 and 18 are attached end to end as shown utilizing flexible coupling or attachment means (hereinafter described in detail) to permit the housings to be manipulated around the sharp corner formed by the intersection of the sewer pipe 12 and the manhole 28 and around any sharp bends, curves or the like which might occur within the sewer pipe 12. The front (left) end of the first housing 14 includes suitable attaching means, such as eyebolt 30, for the attachment of a suitable movement means, such as a first steel cable 32, for pulling or moving the housings 14, 16 and 18 forward (toward the left) along the sewer pipe 12. Similarly, the rear end of the third or rear housing 18 includes a suitable attaching means, such as an eyebolt 34, for attaching a suitable movement means, such as a second steel cable 36, for pulling or moving the housings 14, 16 and 18 rearward (towards the right) along the sewer pipe 12. The first and second cables 32 and 36 may be manually pulled by an operator or they may be attached to suitable cooperating mechanical winch means (shown schematically as 38 and 40 respectively), which may be hand driven but which are preferably motor driven. The operation of the winch means 38 and 40 is controlled by the operator at the control assembly 20 in a manner which will hereinafter be described. Of course, the first cable 32 emerges from the sewer pipe 12 through a second manhole 29 preferably remotely located from the first manhole 28 through which the housings 14, 16 and 18 are installed within the sewer pipe. Suitable guide rollers 42 may be employed to assist in the pulling of the cables 32 and 36 and to prevent the cables and the electrical control cable 60 from binding upon the sewer pipe 12 or the walls of the manholes 28 and 29 as the housings 14, 16 and 18 move along the sewer pipe 12.

Once the three cleaner apparatus housings 14, 16 and 18 are installed within the sewer pipe 12 as shown, the supporting skids 24 and the cleaner brushes 26 are moved radially outwardly in a manner which will hereinafter be described, to engage the interior of the sewer pipe 12. In the presently preferred embodiment the cleaner apparatus 10 is adapted for cleaning the interior of an eight inch sewer pipe. The housing 14 has an outer diameter of approximately six and one-eighth inches and the supporting skids 24 and cleaner brushes 26 may be extended up to an additional one and seven-eighths inches of outside diameter to accommodate variations in the interior dimensions of the sewer pipe 12 which may occur due to prior repairs or alterations to the pipe.

Once the supporting skids 24 and the cleaner brushes 26 are adjusted to engage the interior of the sewer pipe 12, the cleaner head 22 is rotated and the housings 14, 16 and 18 are pulled along the sewer pipe 12 by the first cable 32. As the cutter apparatus housings 14, 16 and 18 move along the sewer pipe and variations in the diameter of the pipe are encountered, the radial position of the supporting skids 24 may be adjusted to maintain their radial outward pressure against the sewer pipe and to maintain at least the forward housing 14 generally radially centered within the pipe 12 and to prevent the forward housing 14 from rotating relative to the sewer pipe. At the same time, the radial position of the cleaner brushes 26 may be adjusted to maintain the brushes in contact with the interior walls of the sewer pipe 12 for scraping and complete cleaning. The rate of axial movement of the cleaner apparatus 10 along the sewer pipe 12 may be controlled depending upon the amount or degree of cleaning that is required for a particular application (i.e. slower axial movement for more thorough cleaning or removal of additional built up material). In addition, the rate of rotation of the cleaner head 22 can be monitored and changed at any time during the cleaning operation, if required. The entire cleaning operation may be conveniently controlled by an operator at the control assembly 20 as will hereinafter be described in detail.

Once the cutter apparatus 10 has proceeded through the sewer pipe 12 in the forward direction, the apparatus 10 may be pulled rearwardly through the sewer pipe with the cleaner head 22 rotating for additional cleaning. Alternatively, if sufficient cleaning was accomplished during the forward movement of the cleaner apparatus 10, the cleaner apparatus may simply be removed from the sewer pipe 12.

The foregoing general discussion was included to provide a basic understanding of the overall structure and operation of the cleaner apparatus 10. It is belived that this basic understanding will facilitate a better understanding of the more detailed description of the structural and operational features of each of the various assemblies of the apparatus 10 which will hereinafter be separately described.

HYDRAULIC PUMP ASSEMBLY

Figure 2:
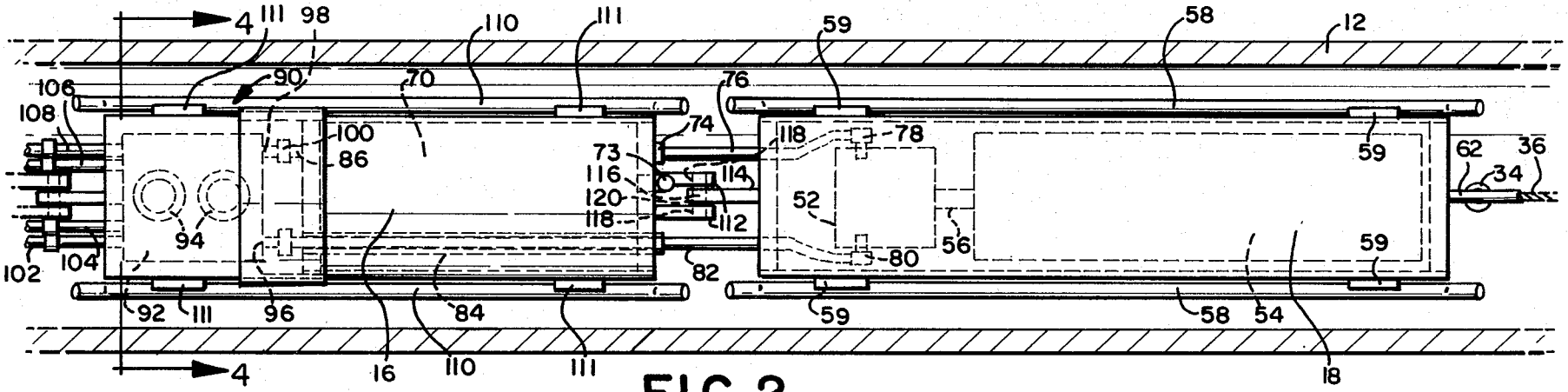
FIG. 2 is an enlarged plan view of the hydraulic fluid reservoir, fluid pump and valve portions of the apparatus of FIG. 1.
Figure 3:
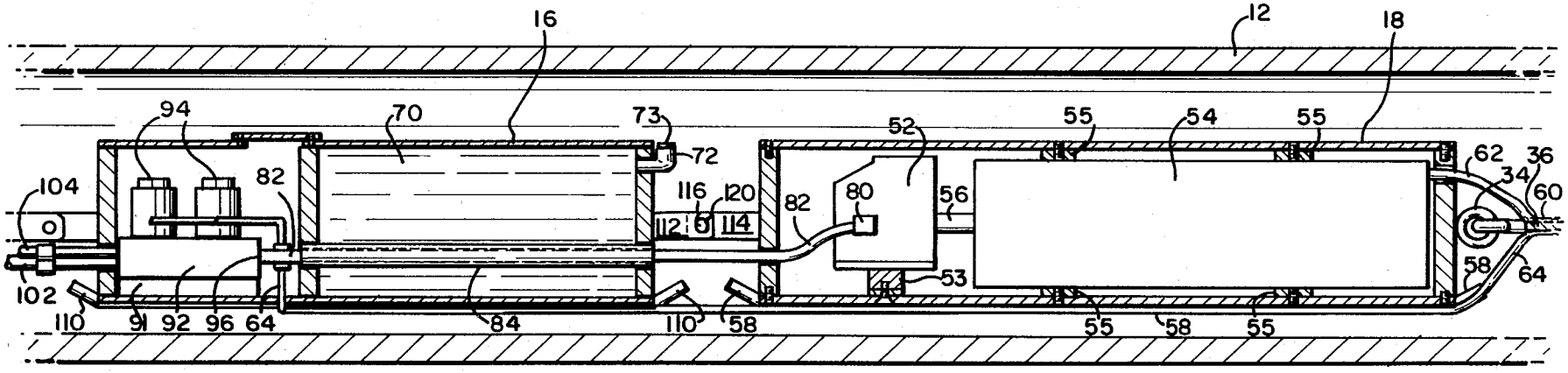
FIG. 3 is a sectional view of the portion of the apparatus shown in FIG. 2.

Referring now to FIGS. 2 and 3, there is shown in greater detail the structural features of the hydraulic fluid pump assembly contained in the third or rearmost housing 18. The hydraulic fluid pump assembly basically comprises a hydraulic pump 52 and a pump driving motor 54.

In the presently preferred embodiment, the hydraulic pump 52 is a standard commercially available model which may be secured to the housing 18 in any suitable manner, for example utilizing a welded support block and bolt arrangement 53 (best seen in FIG. 3). Likewise, the motor 54, which may be similarly secured to the housing 18 by any suitable means, preferably a plurality of spaced, welded support blocks and bolts 55, is a seven horse power 120 volt DC electric motor. The motor 54 is heavily insulated and explosion proof to permit safe operation in the moisture laden, sometimes gas filled environment present within a sewer pipe 12. A more detailed description of the structure and operation of both the hydraulic pump 52 and the electric motor 54 is not necessary for complete understanding of the present invention and, therefore, will not be presented.

Upon the application of electrical current, the armature (not shown) of the motor 54 is driven to rotate in the usual manner. The electric motor armature includes an output shaft 56 which is drivingly coupled or connected to a rotatable impeller or the like (not shown) within the pump 52 so that the rotation of the shaft 56 causes the impeller to rotate. The rotation of the pump impeller pressurizes and propels hydraulic fluid from a fluid source (hereinafter described) to provide the hydraulic power required for the functioning of the cleaner apparatus such as the radial movement of the supporting skids 24 and cleaner brushes 26 and for the rotation of the cleaner head 22.

The hydraulic pump housing 18 is supported for axial movement along the sewer pipe 12 by a pair of generally cylindrical supporting skids 58. In the present embodiment, the supporting skids 58 are generally solid steel guide rails which may be welded or otherwise fixedly attached, utilizing suitable supporting blocks 59, to the bottom or underside of the housing 18 as shown. Both the forward and the rear axial ends of the supporting skids 58 may be slightly curved upwardly as shown to facilitate movement along the sewer pipe 12 and to prevent snagging.

As shown in FIG. 3, the multiple conductor electric cable 60 from the control assembly 20 is split proximate the rear (right) end of the hydraulic pump housing 18 into two smaller diameter electrical cables 62 and 64. Electrical cable 62 is connected directly to the electrical terminals (not shown) of the electric motor 54 to provide power for the operation thereof. Cable 64 extends axially forward beneath the hydraulic pump housing 18.

HYDRAULIC FLUID RESERVOIR AND HYDRAULIC VALVE ASSEMBLIES

Figure 4:
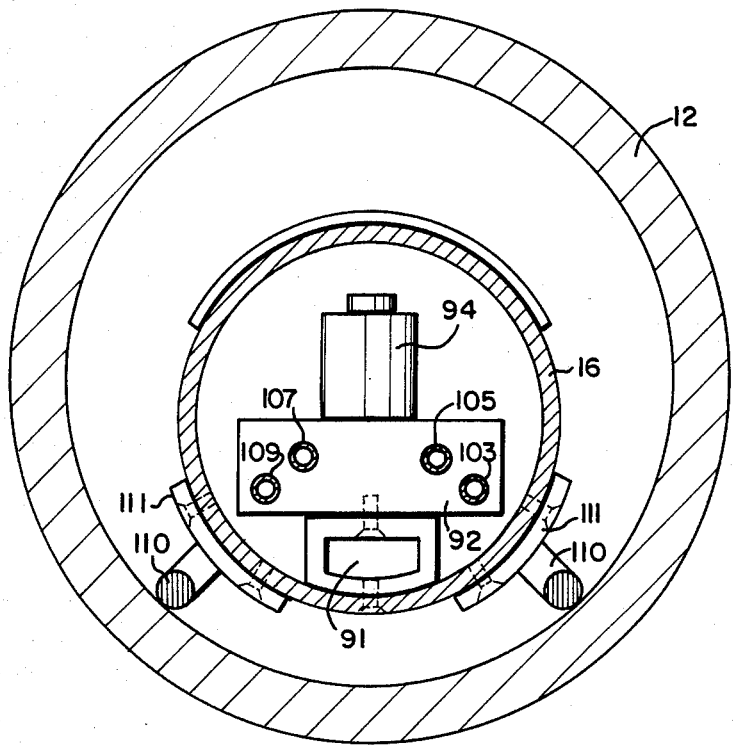
FIG. 4 is a sectional view of a portion of the apparatus taken along line 4—4 of FIG. 2.
Figure 13:
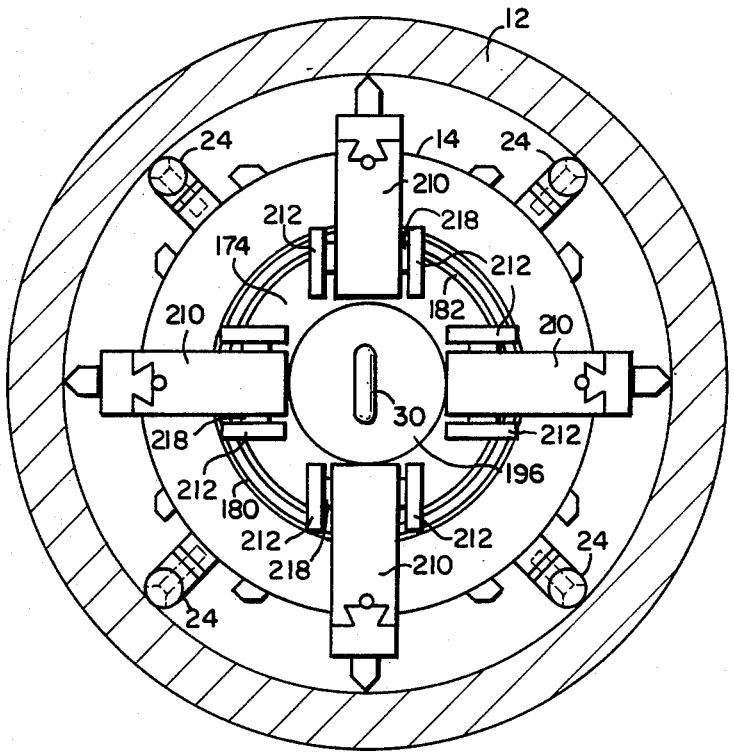
FIG. 13 is an enlarged end view of the portion of the apparatus shown in FIG. 5.

Referring now to FIGS. 2, 3 and 4 there is shown a hydraulic fluid source, in the present embodiment fluid reservoir 70 within the second or intermediate housing 16. The fluid reservoir 70 is generally cylindrical in shape and contains a quantity of hydraulic fluid sufficient to hydraulically control and actuate the various functional features of the cleaner apparatus 10 as will be hereinafter described in greater detail. Hydraulic fluid is installed in the reservoir 70 in the usual manner through a conveniently located fill pipe 72 which is thereafter covered and sealed as shown by a suitably sized sealing device, such as a plug 73. The fluid reservoir 70 further includes a fluid output port 74 which is connected by a suitable fluid conduit or hydraulic hose 76 to a fluid intake port 78 on the hydraulic pump 52. Pressurized fluid emerges from a fluid output port 80 of the hydraulic pump 52 which in turn is connected to another fluid conduit or hydraulic hose 82. Hydraulic hose 82 extends axially forward through the fluid reservoir 70 as shown. A suitable protective sleeve 84 surrounds the hose 82 within the reservoir 70 to prevent the inadvertent leakage of pressurized hydraulic fluid. A fluid return port 86 is provided for the return of hydraulic fluid to the fluid reservoir 70.

A valve means or hydraulic valve assembly shown generally as 90 is supported by any suitable means, for example a welded support block and bolt arrangement 91 within the housing 16 slightly forward of the hydraulic fluid reservoir 70. The primary purpose of the hydraulic valve assembly is to receive pressurized hydraulic fluid from the hydraulic pump 52 and to direct or distribute portions of the pressurized fluid in accordance with control signals received from the control assembly 20 for the purpose of controlling the operation of the cleaner apparatus 10. The hydraulic valve assembly 90 comprises a manifold means or manifold component 92 and a pair of valves, in the present embodiment, electrically operated solenoid valves 94. Pressurized fluid conduit or hydraulic hose 82 is connected to a fluid inlet port 96 on the manifold component 92 to permit the flow of pressurized fluid into the manifold component 92. Correspondingly, the manifold component 92 includes an outlet or fluid return port 98 to which is connected a suitable fluid conduit or hose 100 for transmitting return fluid to the hydraulic fluid reservoir return port 86. The manifold component 92 contains internal connecting conduits (not shown) which can be interconnected by the solenoid valves 94 to direct the received pressurized hydraulic fluid through two fluid conduits or hoses 102 and 104 for the radial movement of the supporting skids 24 and cleaner brushes 26 and for the rotation of the cleaner head 22 in a manner which will hereinafter be described. Similarly, the manifold component 92 functions to direct hydraulic fluid from two fluid return conduits or hoses 106 and 108 to the hydraulic fluid reservoir return port 86. In the presently preferred embodiment, the hydraulic hoses employed are approximately one-half inch in outside diameter and are fabricated of synthetic rubber with fabric braid reinforcement to provide strength and flexibility.

As shown in FIG. 4, the two fluid pressure conduits 102 and 104 are attached to corresponding transfer ports 103 and 105 on the forward face of the manifold component 92. Similarly, the return conduits 106 and 108 are connected to similar transfer ports 107 and 109 on the forward face of the manifold component 92.

Referring again to FIG. 3, it can be seen that the electrical control cable 64 is connected to the electrically operated solenoid valves 94 as shown. Suitable conductors (not shown) within the electrical cable 64 are employed for conducting electrical signals from the control assembly (not shown in FIGS. 2, 3 and 4) to control the position of each of the solenoid valves 94 to cause hydraulic fluid to flow through the various conduits 102, 104, 106 and 108. In addition, the quantity of hydraulic fluid flowing through the conduits 102, 104, 106 and 108 may be controlled by the solenoid valves 94.

As with the previously described hydraulic pump housing 18, the intermediate housing 16 is supported for axial movement along the sewer pipe 12 by a pair of generally cylindrical supporting skids 110. In the presently preferred embodiment, the supporting skids 110 are generally solid, steel guide rails which may be welded or otherwise fixedly attached, utilizing suitable supporting blocks 111, to the bottom or underside of the housing 16 as shown. Both the forward and rear axial ends of the supporting skids 110 may be slightly curved upwardly as shown to facilitate movement along the sewer pipe 12 without snagging.

As previously indicated, it is not advisable to fixedly attach the two housings 16 and 18 together due to the dimensional restrictions involving the corner between the manhole 28 and the sewer pipe 12 as well as any sharp curves or bends within the sewer pipe 12 which might preclude the cleaner apparatus 10 from moving along the sewer pipe. Therefore, the two housings 16 and 18 are flexibly connected together by a pin and clevis arrangement. As best seen in FIGS. 2 and 3, the intermediate housing 16 includes a pair of rearwardly extending generally parallel elongated members 112 which form the clevis. An elongated strut member 114 extends forward from the rear housing 18. Members 112 and strut member 114 each include generally circular openings 118 and 120 respectively which are in registry when the two housings 16 and 18 are serially aligned as shown. A suitable pin 116 extends through the openings 118 and 120 as shown to provide a pivotal connection in the usual manner well known in the clevis/pin art. In this manner, when the two housings 16 and 18 are installed within the sewer pipe 12, the pivotable clevis and pin connection permits the housings 16 and 18 to pivot with respect to each other to provide the necessary flexibility.

SUPPORT MEANS AND CLEANER TOOL MEANS ADJUSTING ASSEMBLY AND CLEANER TOOL MEANS ROTATION ASSEMBLY

Figure 5:
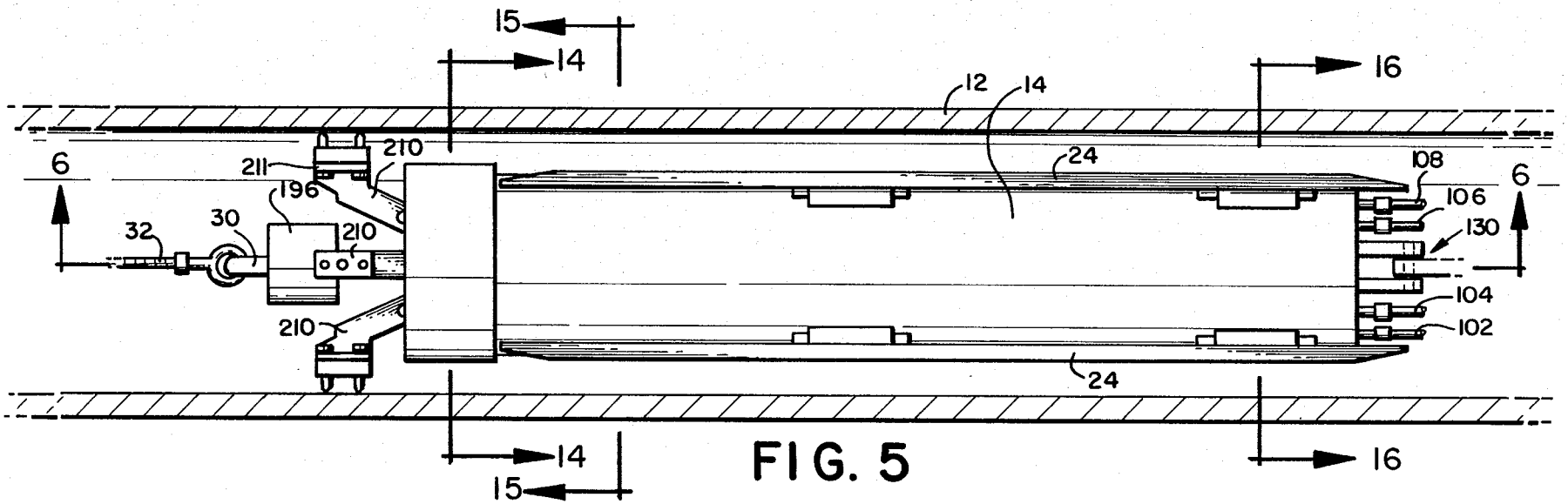
FIG. 5 is an enlarged plan view of a portion of the apparatus of FIG. 1.
Figure 6:
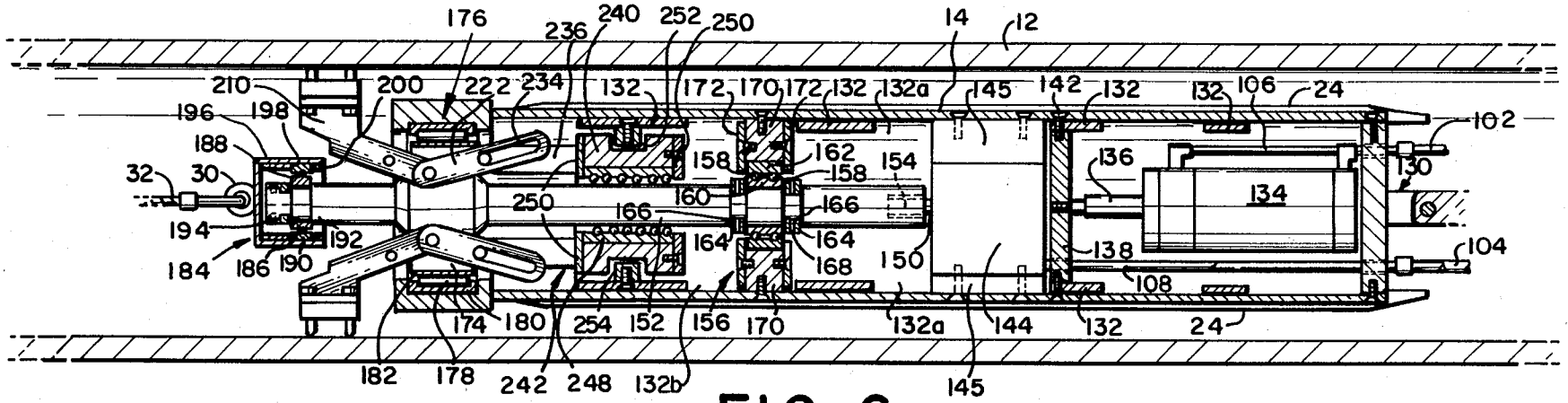
FIG. 6 is a sectional view of a portion of the apparatus taken along line 6—6 of FIG. 5.
Figure 7:
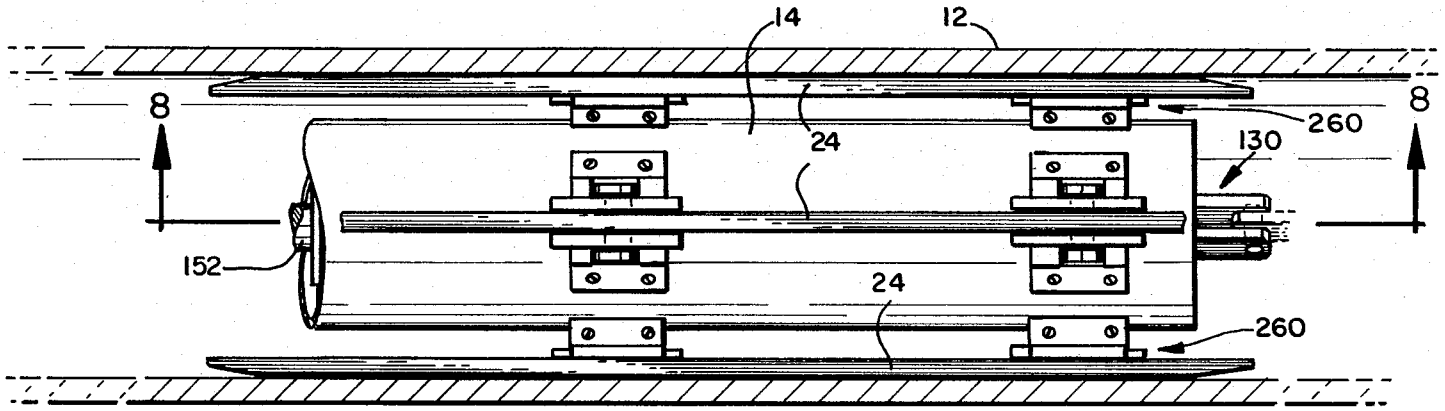
FIG. 7 is a view similar to FIG. 5 but rotated 45 degrees around the housing.

Referring now to FIGS. 5 and 6 there is shown the structural details of the assemblies contained within the forwardmost housing 14. In order to simplify the present discussion, each of the assemblies contained within housing 14 will be separately described, it being understood that in the actual embodiment of the invention they function concurrently.

Housing 14 is attached to intermediate housing 16 by a clevis and pin connection, shown generally as 130, of the type previously described above in connection with the interconnection of housing 16 and housing 18. A detailed description of the clevis and pin connection 130 is not necessary for a complete understanding of the present invention and, therefore, will not be presented.

The first assembly positioned within housing 14 is employed for the radial movement of the supporting skids 24 and the cleaner tool means or brushes 26. Unlike the previously described housings 16 and 18, housing 14 includes four supporting skids 26 which are adapted for concurrent radial inward and outward movement to both center the housing 14 within the sewer pipe 12 and to hold the housing 14 in place with respect to the sewer pipe 12 to facilitate rotation of the cleaner head 22.

Concurrent radial inward and outward movement of all four of the supporting skids 24 and all four of the brushes 26 is accomplished through the forward and rearward axial movement respectively of a generally cylindrical, tubular actuator member 132. The tubular actuator member 132, which in the present embodiment is fabricated of steel, has an outer diameter which is slightly less than the inner diameter of the housing 14. The tubular actuator member 132 has an overall axial length which is at least slightly less than that of the housing 14 so that when installed within the housing 14 as shown the tubular actuator member 132 may move axially forward and rearward with respect to the housing 14. In the presently preferred embodiment, approximately $1\frac{5}{8}$ inches of axial movement of the tubular actuator member 132 is required.

The movement of the tubular actuator member 132 is accomplished by hydraulic actuated means, preferably a hydraulic cylinder 134 which is secured to the housing 14 as shown. The hydraulic cylinder 134 is of a type well known in the art and generally commercially available. Specific details of the structure and operation of the hydraulic cylinder will therefore not be presented. Suffice it to say that upon the application of pressurized hydraulic fluid to one axial end of the hydraulic cylinder 134 the fluid causes a piston (not shown) within the cylinder 134 to displace axially along the cylinder (toward the left or right when viewing FIG. 6). A piston rod 136 which is attached to the piston (not shown) extends through a suitably sealed opening (not shown) in the forward end of the hydraulic cylinder 134 for axial movement with the piston. The hydraulic cylinder 134 is spring loaded so that the piston rod 136 is retracted (moves toward the right) in the absence of pressurized hydraulic fluid. In this manner, if there is a failure in the hydraulic fluid source the brushes 26 and skids 24 are retracted inwardly to permit the apparatus 10 to be withdrawn from the sewer pipe 12 for repairs.

The distal end of the piston rod 136 is secured to a generally flat circular member 138. The outer diameter of the circular member 138 is substantially equal to the inner diameter of the tubular actuator member 132 and engages the tubular actuator member 132 as shown in FIG. 6. Suitable means, for example machine screws 142 are employed to secure the circular member 138 to the tubular actuator actuator member 132 with respect to the housing 12. In this manner, axial movement of the piston rod 136 results in corresponding axial movement of the tubular actuator member 132. As best seen in FIG. 6, the piston rod 136 is in its fully extended position and the circular member 138 and the tubular actuator member 132 are in their forwardmost axial position.

Figure 8:
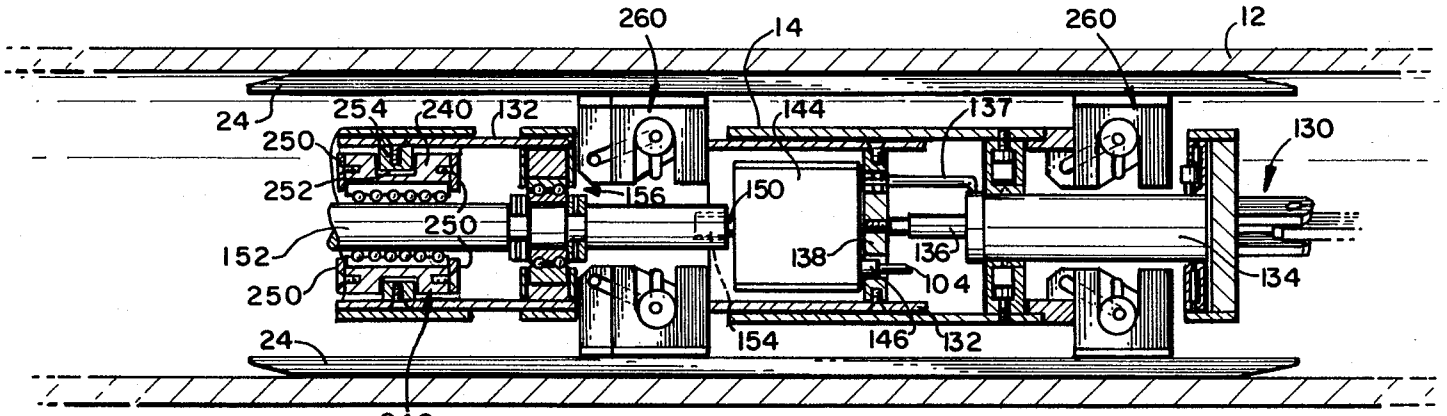
FIG. 8 is a sectional view taken along line 8—8 of FIG. 7.

As best seen in FIG. 8, a position indicator means, in the presently preferred embodiment, a sliding potentiometer 137 is attached to the hydraulic cylinder 134. The resistance of the potentiometer 137 varies in accordance with the axial position of the circular member 138, which then indicates the position of both the cleaner brushes 26 and the supporting skids 24.

Referring again to FIG. 6, a hydraulically powered motor 144 is located in the housing 14 slightly axially forward (toward the left when viewing FIG. 6) of the circular member 138. The hydraulic motor 144 is secured to the housing 14 utilizing a support block and bolt arrangement 145 at four positions placed approximately 90 degrees apart (only two of which are shown in FIG. 6). The tubular actuator member 132 includes four elongated slots, two of which are shown as **132*a* in FIG. 6, which cooperate with the hydraulic motor support blocks 145 to permit the tubular actuator member 132 to move axially forward and rearward without interference from the hydraulic motor 144** or its supports.

The hydraulic motor 144 is of a type which is well known and generally commercially available and, therefore, will not be discussed in detail. Suffice it to say that the motor 144 includes a fluid inlet port 146 for receiving pressurized hydraulic fluid from hydraulic hose 104 and a fluid outlet or return port (not shown) for discharging hydraulic fluid to return hydraulic hose 108. The hydraulic motor 144 receives the pressurized hydraulic fluid and converts the energy thereof into rotary motion of the motor output shaft 150. Suitable bearings (not shown) and seals (not shown) are employed in conjunction with the motor 144 in the usual known manner.

An elongated drive shaft 152 is coupled to the hydraulic motor output shaft 150. In the presently preferred embodiment, the drive shaft 152 and the motor output shaft 150 are coupled for concurrent rotation by a key-type coupling means shown in phantom as 154 of the type well known in the art. The drive shaft 152 extends axially forward from the motor and is supported for rotation relative to the housing 14 at two primary axial locations in a manner which will hereinafter be described. It is the drive shaft 152 which causes the cleaner brush tool 26 to rotate, in a manner which will also be described, for the actual cleaning of the interior of the sewer pipe 12.

The rearmost (rightmost when viewing FIG. 6) support for the drive shaft 152 is provided by a first bearing means shown generally as 156. In the presently preferred embodiment, the first bearing means 156 comprises double thrust bearings 158 having suitable corresponding inner and outer bearing races 160 and 162 respectively. The inner race 160 is held axially in place upon the drive shaft by a pair of split ring keeper members 164, one of which is positioned on each axial side of the inner bearing race 160. The keeper members 164 are seated in annualr slots 166 cut into the drive shaft 152 and may be secured directly to the drive shaft 152 by any suitable means, preferably bolts 168.

The outer bearing race 162 is radially supported by four support blocks, two of which are shown in FIG. 6 as 170, which are spaced approximately 90 degrees apart around the housing 14. Suitable generally flat members 172 are secured to the axial sides of the support blocks 170 and extend slightly radially inwardly as shown to maintain the outer bearing race 162 in a fixed axial position. Suitable elongated slots **132*b* are provided in the tubular actuator member 132 for cooperation with the support blocks 170 to permit the tubular actuator member 132 to move axially without interference from the support blocks 170 or the first bearing means 156**.

As best seen in FIG. 6, the drive shaft 152 includes an enlarged diameter flange portion 174 proximate the forward axial end of the housing 14. The drive shaft flange portion 174 is supported for rotation by a second bearing means shown generally as 176. In the presently preferred embodiment, the second bearing means comprises a needle bearing 178 which is journaled for rotation by inner and outer races 182 and 180 respectively. The outer bearing race 180 in turn is secured to the housing 14 as shown. The inner bearing race 182 is installed with a press fit onto the drive shaft flange portion 174.

By supporting the drive shaft 152 in this manner utilizing first and second bearing means 156 and 176 spaced along the axial length of the drive shaft 152, the drive shaft is rotatably supported and is maintained generally in the radial center of the housing 14. It will be appreciated by those skilled in the art that other types of bearings may be employed for rotatably supporting the drive shaft 152 and that the present invention is not limited to the particular bearing means which are shown and described.

A third bearing means shown generally as 184 is utilized to allow housings 14, 16 and 18 to be pulled axially through existing sewer pipe 12 by means of first steel cable 32 without twisting. The third bearing means 184 comprises a pull thrust bearing 186 having an inner race 188 and an outer race 190. The inner race 188 is secured to a slightly decreased diameter portion of the drive shaft 152 by an annular shoulder 192 and a split ring keeper member 194. Similarly, the outer race 190 is secured to a bearing support member 196 and is maintained axially in place by a shoulder 198 on the bearing support member 196 and a split ring keeper member 200 which is secured to the bearing support member 196 as shown.

Figure 9:
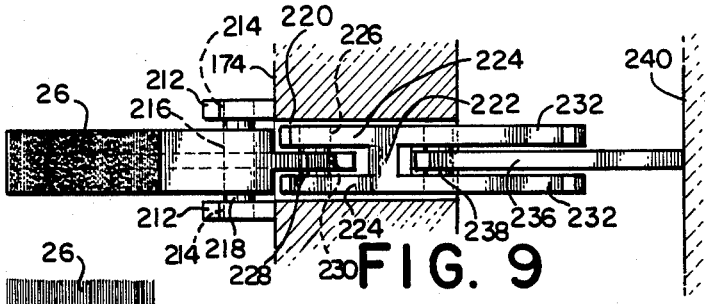
FIG. 9 is an enlarged plan view of one of the cleaner tool means of the apparatus of FIG. 1 and its supporting structure.
Figure 10:
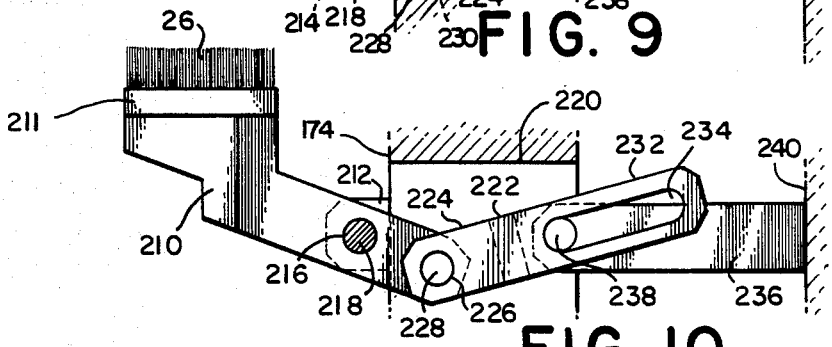
FIG. 10 is an enlarged elevation view, partially in section, of the cleaner tool means of FIG. 9.

Referring now to FIGS. 6, 9, 10 and 14, there is shown, in greater detail, the means for supporting and radially adjusting or moving the cleaner tools or brushes 26. In describing the means for radially moving the brushes 26, only a single brush 26 as shown in FIGS. 9 and 10 will be addressed, it being understood that substantially the same structure is employed in connection with each of the other brushes 26.

Referring now to FIGS. 6, 9 and 10, it can be seen that the brush 26 is located on the distal end of an elongated cleaning tool support arm 210. In the presently preferred embodiment as shown in FIGS. 9 and 10, the cleaning tool which is utilized for cleaning the sewer pipe interior consists of an actual brush. However, it will be appreciated that other similar devices such as a scraper, cutter or the like could alternatively be employed. Means, such as attachment screws, may be employed for releasably securing the brushes 26 to the support arm 210 for interchangeability of other tools. As used herein, the term "brushes" is intended to be generic to include other such devices used for scraping and cleaning the sewer pipe interior.

A spacer member 211 may be employed in conjunction wth the brush 26 and the support arm 210 for adjusting the radial outward extension of the brush 26. The thickness of the spacer member 211 may be varied as necessary to permit the cleaner apparatus to be utilized in cleaning pipes or conduits of different interior diameters.

The support arm 210 is pivotally connected near its longitudinal center to the forward face of the drive shaft flange portion 174. In this manner, the support arm 210 and the brush 26 rotate with the drive shaft 152. A pair of generally parallel lug members 212 are secured to the forward face of the drive shaft flange portion 174 as shown with suitably aligned openings 214 extending therethrough. A similarly sized opening 216 extends through the support arm 210 so that when the three openings are in registry as shown in FIGS. 9 and 10, a suitably sized pin 218 may extend through the aligned openings 214 and 216 to provide a fixed pivot point for the support arm 210. The rear (rightmost) end of the support arm 210 extends through a suitably sized generally rectangular opening 220 which extends axially through the drive shaft flange portion 174 (best seen in FIG. 14). The rear end of the support arm 210 is pivotally connected to a first or forward end of an elongated linking member 222. The forward end of the linking member 222 includes two generally parallel spaced apart legs 224 with generally aligned openings 226 extending therethrough to form a clevis. A suitably sized pin 228 extends through the linking member openings 226 and through a similar sized opening 230 proximate the end of the support arm 210 to pivotally connect the support arm 210 and the linking member 222.

The second, rearmost end of the linking member 222 similarly includes a pair of generally parallel legs 232. As best seen in FIG. 10, each of the legs 232 includes an elongated slot 234 extending generally axially therethrough which serves as a camming means.

An axially extending strut member 236 is positioned between the linking member legs 232 as shown. The forward end of the strut 236 includes a pin member 238 which extends outwardly through the two linking member slots 234 as shown. The other, rearmost end of the strut member 236 is secured, for example by welding, to the forward surface of a generally annular drive member 240. The annular drive member 240 is supported by a fourth bearing means shown generally as 242.

As best seen in FIG. 6, the fourth bearing means 242 comprises a linear bearing 244 having self contained ball bushing bearings (not shown). The outer bearing race 248 is secured to the annular drive member 240 by suitably attached end plates 250 which extend radially inwardly beyond the inner end of the drive member 240 as shown. Segments of end plates 250 are spaced between axially extending strut member 236. The fourth bearing means 242 permits the drive shaft 152 to freely rotate with respect to the annular drive member 240. In addition, the annular drive member 240 is free to move axially (forwardly and rearwardly) along the drive shaft 152 in a manner which will hereinafter be described.

The radially outer face of the annular drive member 240 includes an annular slot 252 which extends around the entire circumference as shown. A corresponding annular flange member 254 secured to the tubular actuator member 132 extends radially inwardly into the annular drive member slot 252 as shown in FIG. 6. In this manner, axial movement of the tubular actuator member 132 and the annular flange member 254 results in corresponding axial movement of the annular drive member 240 along the drive shaft 252.

As best seen in FIGS. 9 and 10, axial movement of the annular drive member 240 results in corresponding axial movement of the strut member 236 which in turn moves the pin member 238 along the parallel linking member slots 234. The linking member slots 234 serve as a camming means and cause the forward end of the linking member 222 to move radially inwardly or outwardly, thereby imparting a similar movement upon the rearmost end of the support arm 210. For example, axial forward movement of the strut member 236 results in the forward end of the linking member 222 moving radially inwardly as shown in FIG. 10. The radial inward movement of the forward end of linking member 222 causes the support arm 210 to pivot in a clockwise direction about pin 218 so that the forward end of the support arm 210 which includes the brush 26 moves radially outwardly as shown in FIG. 10. Correspondingly, rearward axial movement of the strut member 236 causes the support arm 210 to pivot in a counterclockwise direction causing the brush 26 on the forward end of the suppporting arm 210 to move radially inwardly. In this manner, all four of the brushes 26 may be simultaneously moved inwardly or outwardly by the axial movement of the tubular actuator member 132 to engage or disengage the interior surface of the sewer pipe 12. Correspondingly, the brushes 26 may be moved during the cleaning operation to compensate for small changes in the diameter of the sewer pipe 12.

As shown in FIGS. 6, 9 and 10, the support arm 210 is fixed to the drive shaft flange portion 174. Thus, rotation of the drive shaft portion 174 imparts corresponding rotation to the support arm 210 and the connected linking member 222. In this manner, the brushes 26 are driven to rotation to clean the sewer pipe 12. Since the linking member 222 is connected by the strut member 236 to the annular drive member 240, both of these components also rotate upon rotation of the drive shaft 152. Sufficient clearance is provided between the annular drive member slot 252 and the annular flange member 254 for unimpeded rotation of the annular drive member 240.

As previously described, the housing 14 is supported within the sewer pipe by skids 24. As with the previously described housing 16 and 18, the skids 24 are generally solid steel guide rails. However, in the case of housing 14, there are a total of four such skids 24 which are generally equally spaced around the circumference of the housing 14 generally 90 degrees apart. In addition, unlike the skids which are fixed or secured to the previously described housings 16 and 18, skids 24 may be adjusted radially inwardly and outwardly in order to center housing 14 and to prevent the housing from rotating upon rotation of the brushes 26. In the presently preferred embodiment, means are provided for concurrent radial movement of all four of the skids 24.

In the presently preferred embodiment, as shown in FIG. 5, each of the skids 24 is supported at two different axial positions along the length of the housing 14. The structure and operation of each of the skid moving means for each location for each of the four skids 24 is substantially the same. Therefore, in the interest of brevity, only a single skid moving means will be described, it being understood that the same description is applicable for all of the other skid moving means.

Referring now to FIGS. 7, 8, 11, 12 and 16, there is shown the details of the skid moving means shown generally as 260. Skid 24 is attached by suitable means such as screws or bolts to a block-like skid support member 262. A spacer member 261 may be employed between the skid 24 and the skid support member 262 for adjusting the radial outward extension of the skid 24. The thickness of the spacer member 261 may be varied as necessary to accomodate various sized pipes. As previously stated, the presently preferred embodiment is for use in eight inch pipes. By utilizing spacer members 261 with each of the skids 24 and corresponding sized spacer members 211 with each of the brushes 26, the cleaner apparatus may be employed in cleaning larger diameter pipes, such as ten inch pipes.

Figure 11:
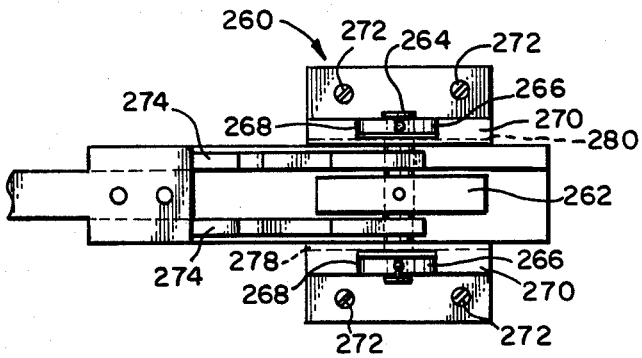
FIG. 11 is an enlarged plan view, partially in section, of the skid adjusting means portion of the apparatus of FIG. 1.
Figure 12:
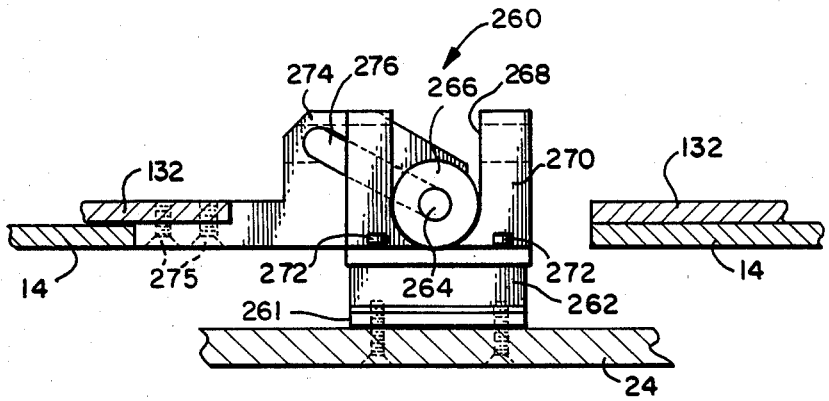
FIG. 12 is an enlarged sectional view of the portion of the apparatus shown in FIG. 11.
Figure 14:
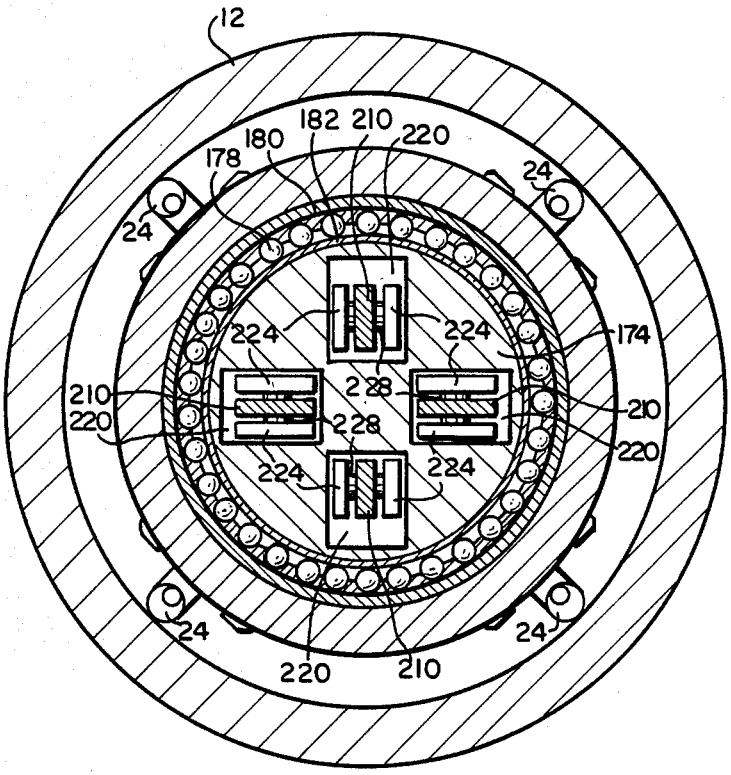
FIG. 14 is a sectional view of a portion of the apparatus taken along line 14—14 of FIG. 5.
Figure 15:
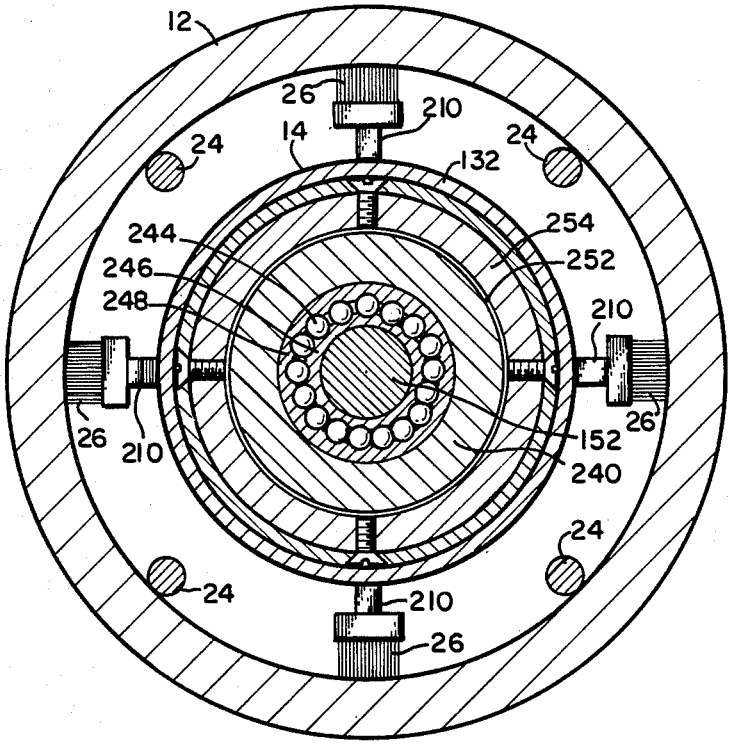
FIG. 15 is a sectional view of a portion of the apparatus taken along line 15—15 of FIG. 5.
Figure 16:
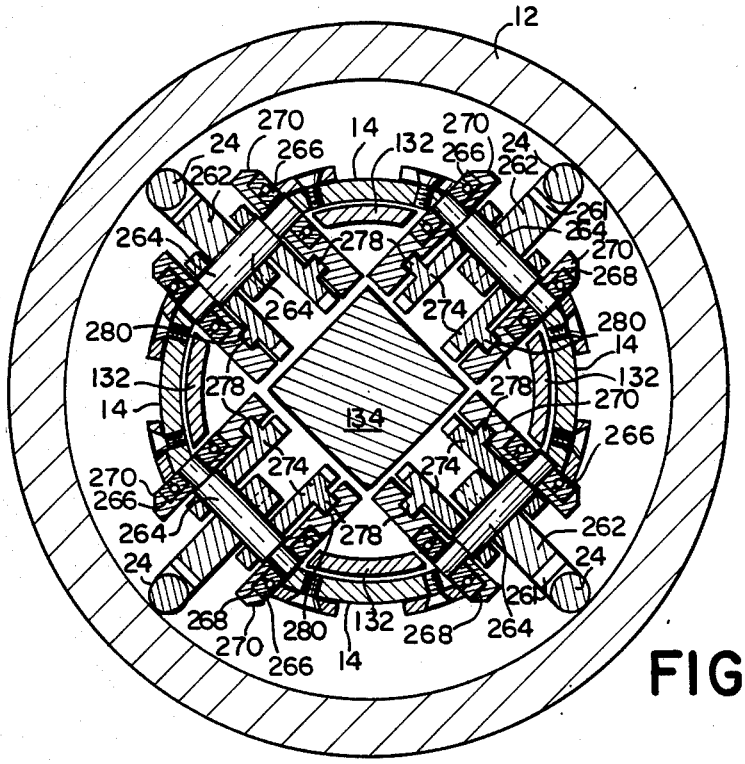
FIG. 16 is a sectional view of a portion of the apparatus taken along line 16—16 of FIG. 5.

As best seen in FIGS. 12 and 16, the skid support member 262 extends radially through an appropriately sized opening or slot in the housing 14 and a corresponding opening or slot in the tubular member 132. The radially inner end of the support member 262 includes a generally cylindrical guide rod 264 extending laterally therethrough as best seen in FIGS. 11 and 16. A roller bearing 266 is attached to each of the distal ends of the guide rod 264. Each of the roller bearings 266 is disposed within a generally extending guide slot 268 of a generally radially extending guide member 270. Each of the radially extending guide members 270 are secured, for example, by suitable screws or bolts 272, to the housing 14. The guide slots 268 and the roller bearings 266 cooperate for inward and outward radial movement of the skid support member 262 in a manner which will hereinafter be described.

Radial movement of the supporting skid 24 is effectuated by a pair of generally parallel, axially extending linking members 274. As best seen in FIG. 12, each of the linking members 274 includes an angular guide slot 276 extending therethrough. As best seen in FIG. 11, the linking members 274 are positioned on both sides of the skid support member 262 with the skid support member guide rod 264 extending through the angular guide slots 276. The axially forward (leftmost when viewing FIGS. 11 and 12) ends of the linking members 274 are secured by means of screws or bolts 275 to the tubular actuator member 132 for movement therewith. As best seen in FIG. 16, each of the linking members 274 includes an outwardly extending flange or lug 278 which engages a corresponding inwardly extending groove 280 within the radially extending guide members 270. The linking member lugs 278 and the radially extending guide member grooves 280 cooperate to insure that the movement of the linking members 274 is generally only in the axial direction. Similarly, the angular guide slots 276 serve as camming means and cooperate with the skid support member guide rod 264 to move the guide rod and thus the skid support member 262 and skid 24 radially inwardly and outwardly upon axial movement of the linking members 274.

In operation, viewing FIGS. 11 and 12, axial movement of tubular actuator member 132 toward the rear results in the rearward or rightward movement of the linking members 274. The rearward movement of the linking members 274 causes the skid support member shaft 264 to move upwardly along the angular guide slot 276. The roller bearings 266 and radially extending guide slots 268 cooperate with each other to insure that the skid support member guide rod 264 moves straight radially inwardly (upwardly when viewing FIG. 12). Correspondingly, the linking member lugs 278 and the guide member grooves 280 insure that the linking members 274 move straight axially. Of course, the radial movement of the skid support member guide rod 264 results in a corresponding radial movement of the skid support member 262 and the skid 24.

As previously indicated, each of the skid moving means 260 are similarly structured and are similarly connected to the tubular actuator member 132 for concurrent radial inward or outward movement of all four of the skids 24. The skids 24 may be moved radially to compensate for small variation in the diameter of the sewer pipe 12 which may occur as the cleaner apparatus 10 moves axially along the sewer pipe 12. In this manner, the skids 24 function to maintain the the housing 14 generally centered within the sewer pipe 12 to promote proper engagement by the brushes 26 for efficient cleaning of the interior of the sewer pipe.

CONTROL ASSEMBLY

Figure 17:
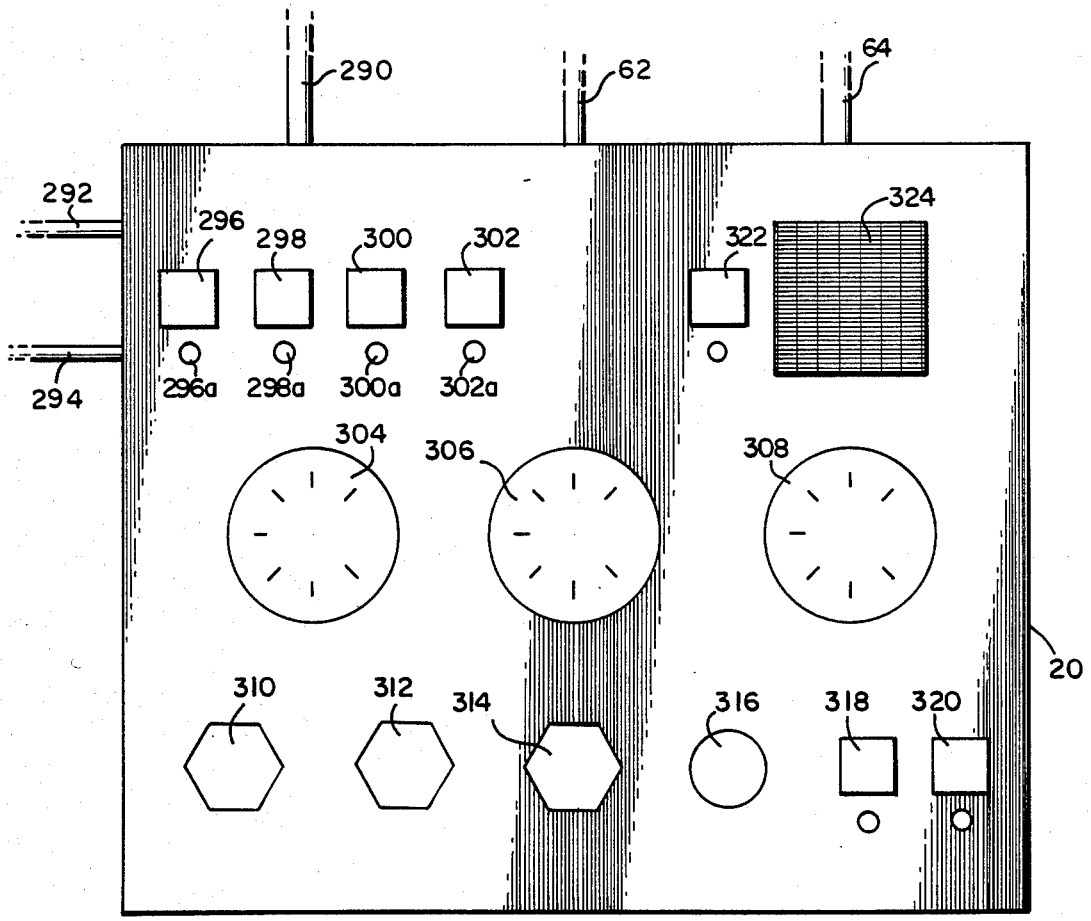
FIG. 17 is a plan view of the control assembly portion of the apparatus of FIG. 1.

Referring now to FIG. 17, there is shown a plan view of a control assembly or control panel 20 in accordance with the present invention. As previously described, the control panel 20 is positioned outside of the sewer pipe 12 to facilitate control of the hydraulic cleaner apparatus 10 as it moves along the sewer pipe 12.

As shown in FIG. 17, the control panel 20 includes switching means, in the presently preferred embodiment, push-button type switches 296, 298, 300 and 302 each of which includes a corresponding on/off indicator means such as indicator lights 296*a*, 298*a*, 300*a* and 302*a*. Push-button switch 296 controls the power to the control panel 20 which is received along electrical power input line 290. Push-button switches 298 and 300 respectively control the power to the forward and rearward winches 38 and 40 respectively, which is transmitted along power lines 292 and 294 respectively. Push-button switch 302 controls the power to the electric motor 54 which drives the hydraulic pump 52.

The control panel 20 includes additional indicator means, in the presently preferred embodiment, gauges 304, 306 and 308, to assist the operator in controlling the operation of the cleaner apparatus 10. In the presently preferred embodiment, gauge 304 comprises a hydraulic pressure gauge, gauge 306 comprises a cleaner position indicator gauge responsive to potentiometer 137 and gauge 308 comprises an ammeter which indicates the electric current flowing to the electric motor 54.

Control means 310, 312 and 314 are joystick-type control switches which are provided to control the forward winch 38, the rearward winch 40, and the inward and outward radial movement of the cleaner brushes 26 and skids 24 respectively.

A rheostat 316 is provided to control the voltage to the electric motor 54 to permit the operator to fine tune the produced torque and thus the pressure of the hydraulic fluid.

Switches 318 and 322 are employed for controlling the operation of the hydraulic motor 144. Switch 318 is a standard push-button on/off switch which when depressed maintains the hydraulic motor 144 in either its on or its off condition. The other switch, 322 is a push and hold type switch which permits the operator to "pulse" the hydraulic motor 144 on at will and to keep the motor 144 on only as long as the switch is depressed. In this manner, the operator is better able to control the cleaning operation.

It has been found that the operator is also better able to control the cleaning operation if he or she is able to hear the cleaning which is being conducted within the sewer pipe 12. Therefore, a suitable microphone (not shown) is provided near the forward end of the cleaning apparatus 10 and a suitable speaker 324 is provided on the control panel 20 for this purpose. A switch 322 is provided to turn the speaker 324 on or off.

ALTERNATE EMBODIMENT

Figure 18:
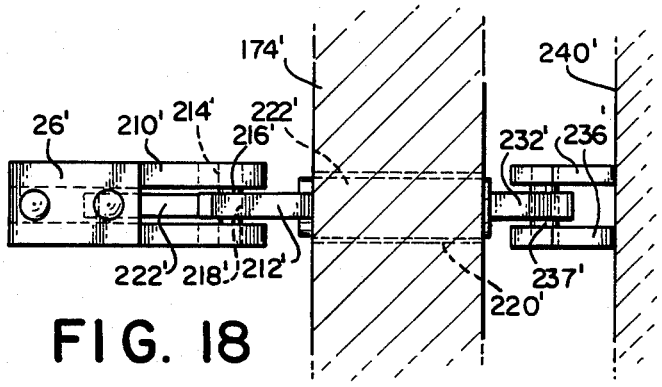
FIG. 18 is an enlarged plan view of an alternate embodiment of the cleaner tool means of FIG. 1.
Figure 19:
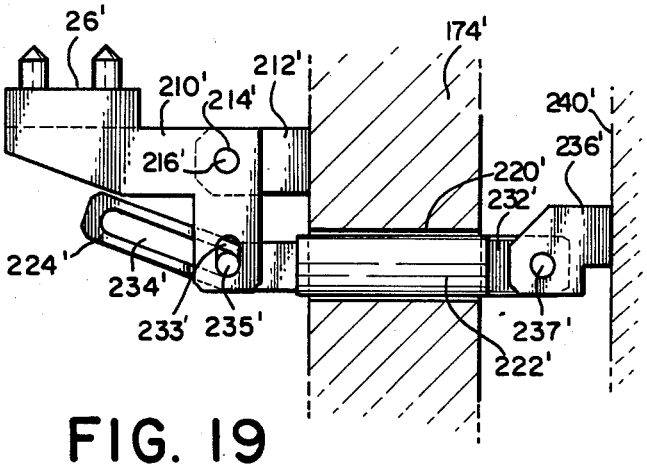
FIG. 19 is an enlarged elevation view of the cleaner tool means of FIG. 18.

Referring now to FIGS. 18 and 19, there is shown an alternate embodiment of the adjustable cleaner tool means. In the embodiment shown in FIGS. 18 and 19, components which are the same or similar to those of corresponding FIGS. 9 and 10 are given the same reference numeral by with the addition of a prime thereto. The remainder of the components remain the same as previously described above in connection with the preferred embodiment.

Referring to FIGS. 18 and 19, it can be seen that the cleaning tool or brush 26' is located on the distal ends of a cleaning tool support arm 210'. As best shown in FIG. 18, the support arm 210' includes two generally parallel L-shaped legs. A lug member 212' is secured to the forward face of the drive shaft flange portion 174' as shown with a generally circular opening 214' extending therethrough. Similarly sized openings 216' extend through the support arm legs 210' is that when the three openings are in registry as shown, a suitably sized pin 218' may extend through the alignment opening 214' and 216' to provide a fixed pivot point for the support arm 210'.

A generally cylindrical elongated linking member 222' is provided for connecting the support arm 210' to the annular drive member 240'. The body portion of the linking member 222' is generally cylindrical as shown. The rearmost end of the linking member 222' includes a generally flat flange portion 232'. A pair of generally parallel lug members 236' are secured to the forward face of the annular drive member 240' as shown. The lug members 236' include suitably aligned openings which when in registry with a similar opening on the linking member flange portion 232' permits a pin member 237' to extend therethrough to pivotally connect the linking member 222' to the annular drive member 240'.

The forwardmost end of the linking member 222' includes an angled forward flange 224' with an angled slot 234' extending therethrough. A pin member 235' extends between generally oval slots 233' within the parallel legs of the support arm 210' and through the linking member slot 234' as shown. The linking member slot 234' cooperates with the pin member 235' to provide a camming means for the pivoting of the support arm 210'. The oval slots 233' permit proper clearance for the pivotal movement of support arm 210'.

In operation, forward (leftward) movement of the annular drive member 240' results in the forward movement of the linking member 222'. The forward movement of the linking member 222' causes the linking member slot 234' to cause the support arm 210' to pivot in a clockwise direction about pin 216'. Similarly, movement of the annular drive member 240' in the rearward (rightward) direction causes the linking member slot 234' to pivot the support arm 210' in the counterclockwise direction.

From the foregoing description it can be seen that the present invention comprises a hydraulically operated remotely controlled cleaner apparatus which is particularly adapted for use in the cleaning of an elongated conduit or pipe having variations in diameter. It will be recognized by those skilled in the art that changes may be made to the above-described embodiments of the invention without departing from the broad inventive concepts thereof. If is understood, therefore, that this invention is not limited to the particular embodiments disclosed, but it is intended to cover any modifications which are within the scope and spirit of the invention as defined by the appended claims.

I claim:

1. A remotely controlled, hydraulically operated cleaner apparatus for use in cleaning the interior of a conduit comprising:

control means located outside of the conduit for generating control signals for controlling the operation of the cleaner apparatus;

a source of pressurized hydraulic fluid;

valve means for receiving both pressurized hydraulic fluid from the fluid source and control signals from the control means and for distributing the received hydraulic fluid in accordance with the received control signals;

a housing;

a hydraulically powered motor within the housing, said motor receiving hydraulic fluid from the valve means for operation thereof;

adjustable cleaner tool means cooperating with the motor for rotation relative to the conduit upon operation of the motor, said cleaner tool means being adjustable to maintain engagement with the interior walls of the conduit;

adjustable support means for supporting the housing within the conduit;

hydraulically actuated means for receiving hydraulic fluid from the valve means, said hydraulically actuated means including means for adjusting the adjustable support means to maintain the housing generally radially centered within the conduit whereby the housing is moved along the conduit with the motor in operation so that the cleaner tool means rotate while engaging in the interior conduit walls for cleaning the interior of the conduit.

2. The apparatus as recited in claim 1 wherein the source of pressurized fluid comprises:

a hydraulic fluid reservoir located within the conduit, the reservoir containing a quantity of hydraulic fluid; and a hydraulic pump located within the conduit, the pump including an intake side which is connected by a fluid conduit to the reservoir for receiving hydraulic fluid therefrom and an output side which is connected by a fluid conduit to the valve means for supplying pressurized fluid thereto.

3. The apparatus as recited in claim 2 wherein the source of pressurized fluid further comprises an electric motor drivingly coupled to the hydraulic pump.

4. The apparatus as recited in claim 3 wherein the reservoir, the pump and the electric motor are generally cylindrical and positioned end to end along a common axis.

5. The apparatus as recited in claim 1 wherein the valve means comprises:

manifold means including an inlet port for receiving the pressurized fluid from the fluid source, an outlet port for transmitting return fluid to the fluid source and a plurality of fluid transfer ports for transmitting pressurized hydraulic fluid to and receiving return hydraulic fluid from the hydraulically powered motor and the hydraulically actuated means; and valves for selectively directing the hydraulic fluid between the manifold means inlet and outlet ports and the manifold means transfer ports in accordance with the received control signals.

6. The apparatus as recited in claim 5 wherein the control signals are electrical and the valves comprise electrically operated solenoid valves.

7. The apparatus as recited in claim 5 further including conduit means connected to the manifold means fluid transfer ports for conducting hydraulic fluid between the manifold means and the motor, and between the manifold means and the hydraulically actuated means.

8. The apparatus as recited in claim 1 wherein the housing is generally cylindrical.

9. The apparatus as recited in claim 1 wherein the hydraulically actuated means also includes means for adjusting the adjustable cleaner tool means to maintain the cleaner tool in engagement with the interior walls of the conduit to compensate for variations in the diameter of the conduit.

10. The apparatus as recited in claim 9 wherein the hydraulically actuated means comprises a hydraulic cylinder secured to the housing, the hydraulic cylinder including a piston and piston rod adapted for translation within the cylinder in accordance with hydraulic fluid received from the valve means; and an actuator member connected to the piston rod for translation therewith.

11. The apparatus as recited in claim 10 wherein the housing is generally cylindrical and the actuator member is generally cylindrical with an outer diameter at least slightly less than the inner diameter of the housing.

12. The apparatus as recited in claim 1 further including an elongated drive shaft connected to the motor, the adjustable cleaner tool means being connected to the drive shaft for rotation therewith.

13. The apparatus as recited in claim 12 wherein the adjustable cleaner tool means comprises:

a cleaner tool;

an elongated support arm pivotally connected to the drive shaft for rotation therewith, the cleaner tool being secured to one end of the support arm; and a linking member pivotally connected to the support arm and to the hydraulically actuated means whereby actuation of the hydraulically actuated means moves the linking member to pivot the support arm to adjust the position of the cleaner tool relative to the interior of the conduit.

14. The apparatus as recited in claim 1 wherein the adjustable support means comprises a plurality of elongated axially extending skids disposed around the housing.

15. The apparatus as recited in claim 14 wherein the skids are adapted for radial movement with respect to the housing to engage the interior of the conduit.

16. The apparatus as recited in claim 15 wherein all of the skids move concurrently radially inwardly or radially outwardly.

17. The apparatus as recited in claim 14 wherein said hydraulically actuated means includes at least two generally parallel, axially spaced support members supporting each of said skids and which extend through suitably sized openings within the housing.

18. The apparatus as recited in claim 17 wherein each of the support members includes a laterally extending guide rod and further including at least one linking member connected to the hydraulically actuated means for axial movement with respect to the housing, the linking member including angled camming means for engaging the guide rod for moving the support member.

* * * * *